US005864094A

United States Patent [19]

Griffin

[11] Patent Number: 5,864,094

[45] Date of Patent: Jan. 26, 1999

[54] POWER CABLE

[76] Inventor: Michael D. Griffin, 2616 Winter Park Rd., Rochester Hills, Mich. 48309

[21] Appl. No.: 769,816

[22] Filed: Dec. 19, 1996

[51] Int. Cl.[6] ..... H01B 7/18

[52] U.S. Cl. ..... 174/105 R; 174/113 R

[58] Field of Search ..... 174/105 R, 113 R, 174/36, 69, 107, 110 V

[56] References Cited

U.S. PATENT DOCUMENTS

| | | | |
|---|---|---|---|
| 3,102,160 | 8/1963 | Cook et al. | 174/105 R |
| 3,324,229 | 6/1967 | Ingmanson | 174/69 |
| 3,484,532 | 12/1969 | Anderson | 174/105 R X |
| 3,571,490 | 3/1971 | Bunish et al. | 174/113 R |
| 3,584,139 | 6/1971 | Swanson | 174/105 R X |
| 3,622,683 | 11/1971 | Roberts et al. | 174/105 R X |
| 4,317,002 | 2/1982 | Spicer | 174/150 R |
| 4,563,540 | 1/1986 | Bohannon, Jr. et al. | 174/105 R X |
| 4,579,420 | 4/1986 | Winter et al. | 174/105 R X |
| 4,654,476 | 3/1987 | Baraicel-Ottler et al. | 174/116 |
| 5,109,140 | 4/1992 | Nguyen | 174/36 |
| 5,110,999 | 5/1992 | Barbera | 174/36 |
| 5,113,040 | 5/1992 | Hose et al. | 174/116 |
| 5,149,915 | 9/1992 | Brunker et al. | 174/36 |
| 5,310,964 | 5/1994 | Roberts et al. | 174/121 A |
| 5,408,560 | 4/1995 | Seynhaeve et al. | 385/101 |
| 5,491,299 | 2/1996 | Naylor et al. | 174/36 |
| 5,521,333 | 5/1996 | Kobayashi et al. | 174/113 R |
| 5,523,528 | 6/1996 | Bese et al. | 174/36 |

FOREIGN PATENT DOCUMENTS

| | | | |
|---|---|---|---|
| 259467 | 4/1964 | Netherlands | 174/113 R |

*Primary Examiner*—Bot Ledynh
*Assistant Examiner*—Chau N. Nguyen
*Attorney, Agent, or Firm*—Young & Basile, P.C.

[57] ABSTRACT

An electrical power cable includes a central ground conductor surrounded by an insulating material layer. An inner grounded shield is formed on the surface of the ground conductor or between the ground conductor and line and neutral conductors. A plurality of insulated line conductors and a plurality of insulated neutral conductors are circumferentially disposed in an annular arrangement about an insulation layer on the inner shield. The plurality of line and neutral conductors are each disposed circumferentially side-by-side in separate groups of line and neutral conductors. The total cross-sectional area of each group of line conductors and neutral conductors is substantially equal to the total cross-sectional area of a single large conductor of equivalent ampere rating. An outer shield is disposed about the line and neutral conductors and covered by an outer insulating layer. PVC insulation surrounds all of the conductors and is used to form the shields and other insulating layers to minimize movement of the individual conductors within the cable.

30 Claims, 2 Drawing Sheets

POWER CABLE

BACKGROUND OF THE INVENTION

1. Field of the invention

The present invention relates, in general, to electrical conductors, and, more specifically, to shielded electrical power supply cables.

2. Description of the Art

Internal electrical wiring in residential homes for 15 ampere A.C. power supply electrical service has for years been standardized as 14-2G type NM-B sheathed cable. This sheathed cable consists of three 14 gage solid conductors, with the line and neutral conductors individually insulated and disposed in a parallel flat lay on opposite sides of an insulated ground conductor. This cable construction has several features which minimize magnetic field interaction and damping of mechanical vibrations generated by the 60 Hz North America electrical power carrier frequency. Such features include the spacing apart of the current carrying line and the neutral conductors, the use of relatively stiff, solid 14 AWG conductors, and relatively stiff insulation and cable jacket. These features combine to resist the repelling forces caused by the magnetic fields associated with the two closely spaced line and neutral conductors.

Conversely, typical A.C. power supply cords for electrical appliances, such as audio amplifiers, preamplifiers, etc., have a construction which is optimized for maximum flexibility and durability in potentially high flex cycle applications. Such power supply cords have close conductor spacing geometry which increases magnetic interaction between the line and neutral current carrying conductors. Such cords also typically use stranded conductors and soft fillers, such as cotton and paper, between the conductors and the outer jacket material. All of these features compromise the self-damping quality of the power supply cord thereby leading to increased vibration of the individual conductors due to the interacting magnetic fields generated by the current carrying conductors. The movement of the conductors due to magnetic field interaction is also enhanced by the use of the soft fillers and the relatively flexible outer jacket.

Thus, it would be desirable to provide a power supply cable, particularly suited for use in supplying electrical power to audio equipment, which has reduced vibration of the individual current carrying conductors, has a reduced inductance, has a solidly filled construction to minimize any movement of the individual conducts within the cable, and has a line and neutral conductor arrangement which minimizes magnetic field interaction between the line and neutral conductors within the cable.

SUMMARY OF THE INVENTION

The present invention is an electrical power cable which is particularly useful in supplying A.C. electrical power to audio equipment.

The electrical power cable of the present invention includes a centrally disposed ground conductor surrounded by a first insulating material layer. A plurality of line conductors, each of like gage and covered by a second insulating material layer, are disposed about the first insulating layer of the ground conductor. A plurality of neutral conductors, each also of like gage and covered by a third insulating material layer, are disposed about the insulating layer of the ground conductor. A fourth insulating material layer surrounds the line and neutral conductors. A grounded outer shield is disposed about the fourth insulating material layer. An outer insulation material layer covers the outer shield.

Preferably, the plurality of line conductors are disposed circumferentially side-by-side with respect to each other about the center ground conductor. Likewise, the plurality of neutral conductors are disposed circumferentially side-by-side with respect to each other about the central ground conductor and disposed opposite from the line conductors. Further, the total cross-sectional area of the plurality of line conductors and the total cross-sectional area of the plurality of neutral conductors is substantially equal to the cross-sectional area of a single line conductor and a single neutral conductor of an equivalent electrical ampere rating.

All of the insulating material layers used in the power cable of the present invention are preferably formed of a semi-rigid, substantially non compressible material, such as PCV, to prevent movement of the individual conductors with respect to each other within the power cable.

An inner grounded shield is formed, in one embodiment, by the outer surface of the ground conductor. In another embodiment, a grounded conductive inner shield is spaced from the ground conductor by an insulating material layer. The inner shield is separated from the plurality of line and neutral line conductors by another insulating material layer. The outer diameter of the first insulating material layer in the first embodiment or the outer diameter of the insulating material layer surrounding the inner shield in the other embodiment enables the line and neutral conductors to lie in one annular ring in contact with each other.

In one embodiment, the thickness of the insulation material layers surrounding the line and neutral conductors, the center ground conductor and between the center ground conductors, the inner shield means, and the outer shield are substantially equal.

The electrical power cable of the present invention provides numerous advantages over previously devised power supply cables, particularly power cables used to supply A.C. power to audio equipment. The fixed non-movable positioning of the individual conductors within the cable in combination with the use of a plurality of smaller gage conductors for the line and neutral conductors which reduces magnetic field interaction between the current carrying line and neutral conductors minimizes movement or vibration of the conductors which heretofore has generated eddy current which reduce the amount of current carried by power cables. Further, the use of the plurality of small gage line and neutral conductors substantially reduces the cross-sectional area between the inner and outer shields of the cable thereby significantly reducing the inductance of the cable which heretofore also reduced the amount of current carried by the cable.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
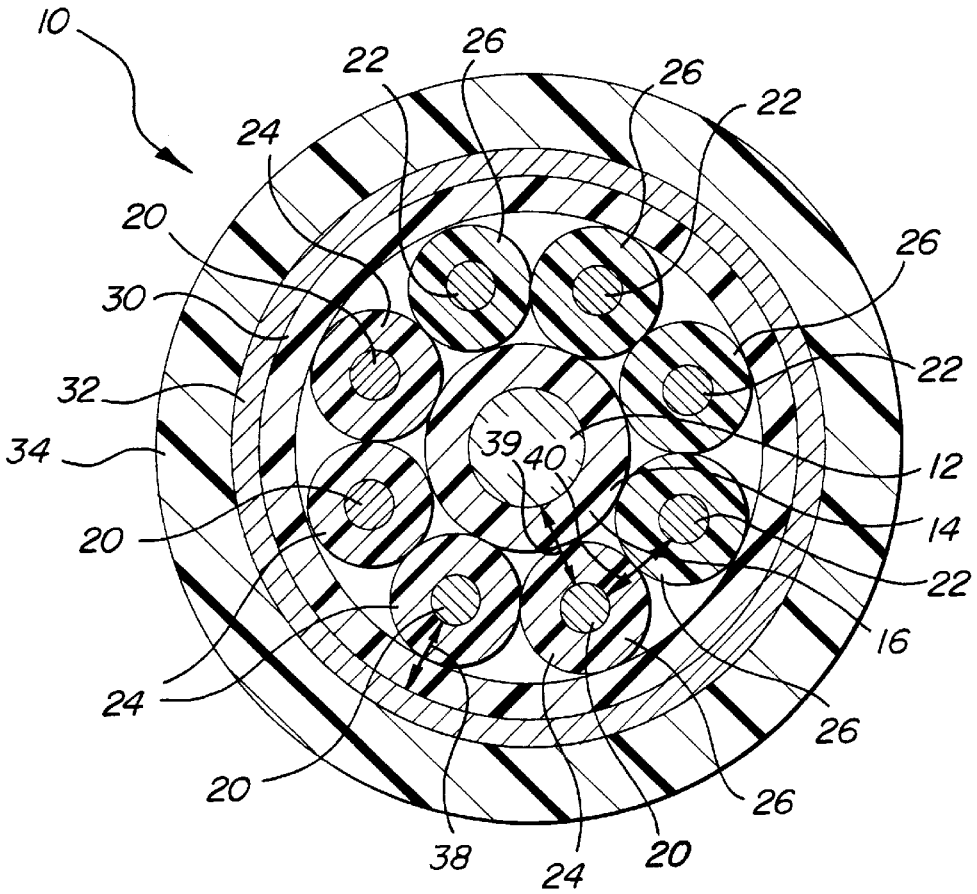
FIG. 1 is a cross sectional view of a power cable constructed in accordance with the teachings of one embodiment of the present invention.

Referring now to the drawing, and to FIG. 1 in particular, there is depicted one embodiment of a power cable 10 according to the present invention.

The power cable 10 will be described hereafter in a specific application as being equivalent to a 14 AWG power cable. It will be understood that teachings of the present invention may be applied to different gage power cables, as described by example in the embodiment shown in FIG. 2.

The power cable 10 includes an inner, centrally located ground conductor 12. The outer surface 14 of the inner conductor 12 acts as an inner shield for the power cable 10. In the specified example of a 14 AWG power cable, the ground conductor 12 must be at least a 14 AWG conductor to meet its required safety rating. However, in this embodiment, the ground conductor 12 is made oversized, i.e., a larger diameter gage, such as a 12 AWG conductor of either stranded or solid wire. An insulating material layer 16 with a minimum insulation thickness of 0.032 inches is disposed or wrapped about the ground conductor 12. The described oversized 12 AWG ground conductor 12 provides additional functionality as an inner shield since the outer diameter of the ground conductor 12 is positioned to reduce the cross-sectional area or the cable 10 containing the line and neutral conductors described hereafter.

The insulation 16 surrounding the ground conductor 12 may be formed of any suitable electrical insulating material. Preferably, PVC material in employed due to its relative stiffness and non-compressibility which aids in damping any vibration of the conductor 12.

The single line conductor and single neutral conductor normally used in a 14 AWG power cable are replaced in the present power cable 10 by a plurality of individual, smaller gage conductors. The plurality of small gage conductors have a combined or total cross-sectional area substantially equal to the cross-sectional area of the single 14 AWG conductor they replace. Since a 14 AWG conductor has a cross-sectional area of 0.00323 inches$^2$, four 20 AWG conductors which have a combined cross-sectional area of 0.00328 inches$^2$ are used for each of the individual line conductors and each of the individual neutral conductors. Thus, as shown in FIG. 1, the power cable 10 includes four 20 AWG neutral conductors 20 and four 20 AWG line conductors 22. Any conductor size which is 20 AWG or smaller is preferred for flat inductance and no frequency roll off.

In a preferred embodiment, and as shown in FIG. 1, each group of neutral conductors 20 and line conductors 22 are arranged side-by-side with the outer insulation jackets or layers 24 and 26, respectively of each conductor 20 and 22 contacting the insulation jacket on the adjacent conductor. Thus, as shown in FIG. 1, the four neutral conductors 20 are arranged side-by-side along the one arcuate portion of the ground conductor 12; while the neutral conductors 22 are arranged side-by-side on an opposite arcuate side of the ground conductor 12.

This arrangement provides several benefits. Magnetic interaction between the opposing magnetic fields generated by the line and neutral conductors 22 and 20 is substantially reduced since only two of the four conductors in each group of line and neutral conductors 22 and 20 are disposed immediately adjacent to a conductor in the other group. Further, since each small gage conductor generates a proportionally smaller magnetic field, the total interaction of the magnetic fields generated by the individual neutral conductors 20 and the individual line conductors 22 is substantially reduced as compared to a 14 AWG power cord having a single 14 gage line conductor and a single 14 gage neutral conductor. Since the magnetic field interaction is reduced, the tendency of the line and neutral conductors 22 and 20 to vibrate or move when carrying current is substantially reduced. It is believed that the reduction in vibration reduces eddy currents in the electrical power supplied by the power cable 10 and thereby minimizes distortion.

Further, as shown FIG. 1, the use of small gage conductors 20 and 22 enables the insulation jackets 24 and 26 on the neutral conductors 20 and the line conductors 22, respectively, to be disposed in contact with the insulation jackets of adjacent conductors as well as the insulation layer 16 surrounding the ground conductor 12 to dispose the conductors 20 and 22 in a single, annular arrangement about the ground conductor 12. Further the insulation is preferably PVC which is substantially non-compressible. This provides a completely filled, unmovable conductor arrangement about the ground conductor 12 which again aid in damping mechanical vibrations. Prior power cables typically use soft cotton, paper or polyester fibers as filler between individually insulated conductors. These soft fillers allow movement of the conductors in the cable due to vibrations resulting from magnetic field interaction between the current carrying conductors. Such movement generates eddy currents which subtract from the total current supplied by the cable.

Figure 4:
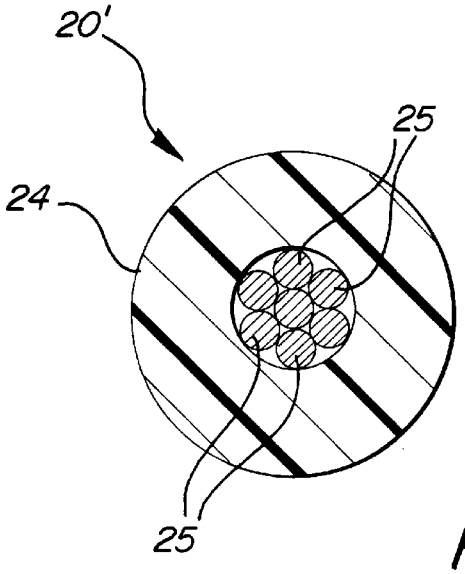
FIG. 4 is an enlarged cross-sectional view of an alternate line or neutral conductor formed of stranded wires.

Preferably, the individual neutral conductors 20 and the individual line conductors 22 are each formed of a solid conductor surrounded by a single insulation layer 24 or 26, preferably of PVC. The single conductor covered with an outer insulation jacket affords an optimum stiffness versus flexibility characteristic for mechanical damping of any induced vibrations in the conductor. Stranded conductors, also shown in FIG. 4, may also be employed for the line and neutral conductors, such as conductor 20, as long as the strands 25 are arranged in a "perfect lay" in the conductor 20. In this example, 7 strands of 28 AWG wire are arranged six around one to form a composite 20 AWG conductor.

Figure 3:
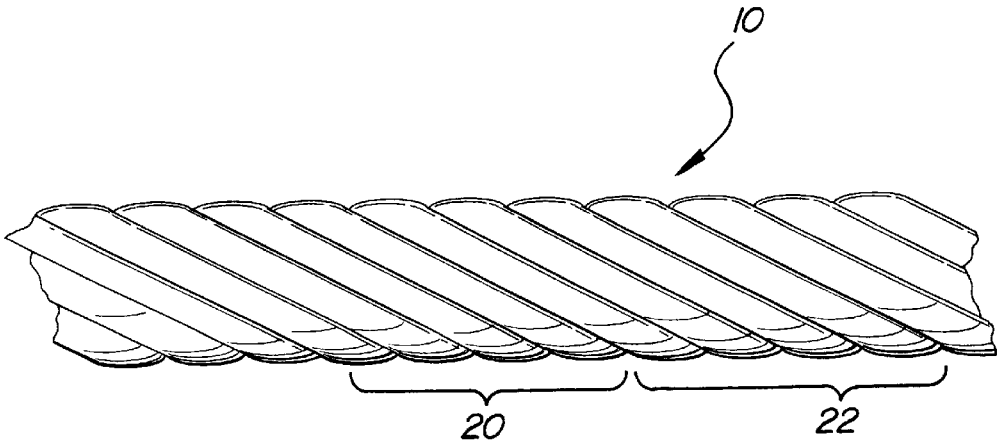
FIG. 3 is a partial, side elevational view of the helical lay of the conductors in the inventive power cable.

As shown in FIG. 3 the plurality of line and neutral conductors 22 and 20 are preferably wrapped in a helical arrangement about the ground conductor 12 and along the length of the power cable 10 to break up coil inductance in the power cable 10. However, a parallel arrangement of the conductors 22 and 20 is also feasible in the power cable 10.

An inner jacket 30 formed of an electrical insulating material, preferably PVC, is disposed around and in intimate contact with the insulation jackets 24 and 26 of the neutral conductors 20 and the line conductors 22, respectively. The inner jacket 30 serves to maintain the conductors 20 and 22 in their specified side-by-side arrangement as well as adding an additional degree of stiffness to the power cable 10 to resist any movement or vibration of the individual conductors 20 and 22 within the power cable 10.

An outer ground shield 32 is disposed about the inner jacket 30. The outer shield 32 is formed of a suitable conductive material, such as copper braid, aluminum foil, etc. Finally, an outer electrical insulating material jacket 34 is disposed about the outer shield 32 to complete the power cable 10. The outer insulating layer 34, like the inner jacket 30 is also formed preferably of PVC.

The power cable 10 also includes several dimensional relationships between the individual components which significantly improves its performance. First, the diameter or gage of the ground conductor 12 and the thickness of the insulating layer 16 disposed about the inner ground conductor 12 are selected to provide a combined outer diameter which closely conforms to the inner diameter of the plurality of line and neutral conductors 20 and 22 disposed about the ground conductor 12. This is to insure registry of all of the conductors 20 and 22 within the power cable 10 to minimize movement caused by any induced vibrations in the conductors 20 and 22.

In addition, the thickness of the insulating jackets 24 and 26 on the neutral conductors 20 and line conductors 22 are optionally at least equal to the diameter of each conductor 22 and 20. Thus, for the exemplary 20 AWG conductors 20 and 22 which have a diameter of approximately 0.032 inches, the thickness of the jackets 24 and 26, respectively, is also 0.032 inches. In the specified side-by-side arrangement of the neutral conductors 20 and the line conductors 22, this insulation thickness significantly contributes to minimizing magnetic field interaction between the conductors 20 and 22 as compared to typical power cable conductor construction. Since magnetic field strength is a square function of the distance from the center of the conductor, the present power cable 10 spaces the centers of two adjacent conductors 20 and 22 apart by a least three diameters to significantly reduce the strength of the magnetic field generated between two adjacent conductors 20 and 22 carrying current in opposite directions.

The thickness of the various insulation jackets 24 and 26 as well as the thickness of the insulation layer 16 covering the ground conductor 12 and the inner jacket 30 are substantially equal so as to place the various conductors 12, 20 and 22 at an identical distance apart from each other as well as at the same distance from the inner shield 14 as shown by reference number 40 and the outer shield 32. For example, as described above for 20 AWG conductors used for the line and neutral conductors 22 and 20, an insulation jacket of 0.032 inches thick as well as a 0.032 inch thick insulation layer 14 surrounding the ground conductor 12 and a 0.032 inch thick inner jacket 30, will place the outer surface of each of the line and neutral conductors 22 and 20 0.064 inches from the inner surface of the outer shield 32 and 0.064 inches from the outer surface of the inner shield 14 on the ground conductor 12 as shown by reference number 39. The outermost surfaces of conductors 20 and 22 are also spaced 0.064 inches from the outer surface of adjacent conductors, as shown by reference number 39 in FIG. 1. This provides an overall symmetry to the power cable 10 which minimizes magnetic field interaction between the various conductors 20 and 22.

The arrangement of the conductors 20 and 22 in one annular ring between the inner shield 14 and the outer shield 32 also contributes to a minimized cross-sectional area between the inner shield 14 and the outer shield 32 which reduces the inductance of the power cable 10. Any reduction in cable inductance reduces the current lag.

Figure 2:
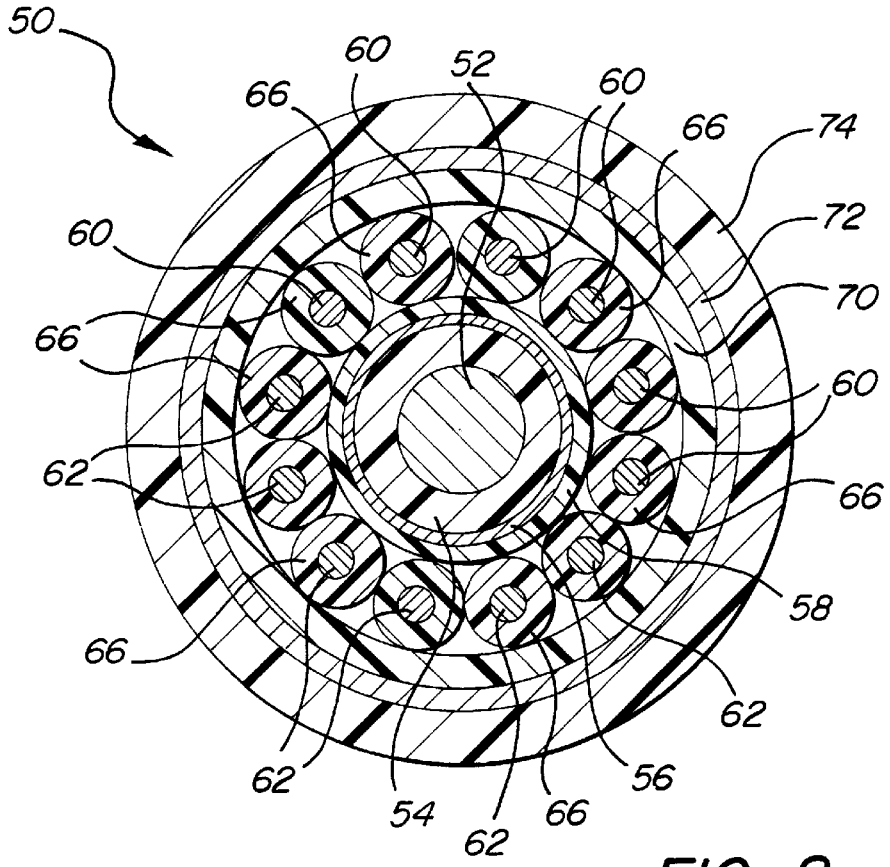
FIG. 2 is a cross-sectional view of another embodiment of a power cable constructed in accordance with the teachings of the present invention.

Referring now to FIG. 2, there is depicted another embodiment of a power cable 50 constructed in accordance with the teachings of the present invention. The power cable 50 is substantially identical to the power cable 10 described above and shown in FIG. 1, except for a few differences which will be enumerated hereafter.

The power cable 50 is designed to replace a 12 AWG power cable containing a single 12 AWG line conductor, a single 12 AWG neutral conductor and a single 12 AWG center located ground conductor. The power cable 50 includes an inner ground conductor 52 which is preferably formed of a single, stranded or solid 12 AWG conductor for electrical rating purposes. An insulation layer 54 surrounds the ground conductor 52. An inner shield 56 is disposed about the insulation layer 54. The inner shield 56 is formed of an electrically conductive material, such as copper braid, aluminum foil etc. Another insulation layer 58 surrounds the inner shield 56, for insulation purposes to provide an appropriate diameter for close fitting of the individual line and neutral line conductors in an annular arrangement, and to minimize cross sectional area between inner and outer shields.

As in the first embodiment, a plurality of neutral conductors 60 and a plurality of line conductors 62 are disposed in two separate groups about the insulation layer 58. Each neutral conductor 60 is disposed side-by-side with an adjacent neutral conductor 60. Similarly, each line conductor 62 is disposed adjacent to another line conductor 62. Each conductor 60 and 62 is covered by a suitable insulation layer or jacket denoted generally by reference number 56.

A plurality of individual line and neutral conductors 62 and 60 are employed to replace a single 12 AWG line conductor and a single 12 AWG neutral conductor. The number of individual line and neutral conductors 62 and 60 is selected to equal the cross-sectional diameter of a single 12 AWG conductor. Thus, six line conductors and six neutral conductors 60 are employed in two separate side-by-side, annular groups within the power cable 50.

The power cable 50 also includes a inner, insulative jacket 70, an outer shield 72 formed of a suitable conductive material, such as copper braid, aluminum foil, etc., and an outer insulative jacket 74.

As in the first embodiment, all of the insulation layers or jackets in the power cable 50 are formed of non-compressive PVC. Further, as in the first embodiment, the thicknesses of the insulation layers and the insulation jackets are selected to provide symmetry between the spacing of the various conductors and shields. Thus, the conductor insulation layer 66 is preferably as thick as the diameter of the conductors 60 or 62, i.e., 0.032 inches for the exemplary 20 AWG conductors. This spaces each conductor 60 and 62 0.064 inches from the adjacent conductor, the inner jacket 70 and the insulating layer 58 are sized to space the conductors 60 and 62 0.045 from the inner shield 56 and the outer shield 72. This arrangement minimizes magnetic field interaction between the various current carrying conductors 60 and 62.

As in the first embodiment, an inner shield is provided in the power cable 50. In the exemplary 12 AWG size cable 50, it is economically impractical to form the ground conductor 52 in a large enough diameter. Thus, a 12 AWG size conductor is employed along with less expensive insulation layers 54 and 58, and the grounded inner shield 56 which is positioned to reduce the overall cross-sectional area and thereby the inductance of the portion of the power cable 50 which carries the current carrying conductors 60 and 62.

In summary, there has been disclosed a unique power cable suitable for use in supplying A.C electrical power to audio equipment. The unique construction of the power cable minimizes magnetic field interaction between the current carrying conductors to reduce vibrations in the conductors. The use of relatively stiff PVC insulation around each conductor and for the various insulating shields and layers in the inventive power cable provides a solid, non-moveable construction for the cable which damps any mechanical vibrations which may be induced in the conductors. Further, the provision of an inner shield and an outer shield surrounding the current carrying conductors and the use of a plurality of smaller diameter conductors having a total cross-section equal to the larger diameter of a single conductor of equivalent ampere rating minimizes the cross-section of the power cable between the inner and outer shields thereby reducing the inductance of the power cable.

What is claimed is:

1. An electrical power cable comprising:

a ground conductor;

a first insulating material layer disposed about the ground conductor;

a plurality of line conductors, each covered with a second layer of insulating material and circumferentially disposed side by side about the first insulating material layer;

a plurality of neutral conductors, each covered by a third layer of insulating material and circumferentially disposed side by side about the first insulating material layer;

a fourth layer of insulating material surrounding the plurality of line conductors and the plurality of neutral conductors;

an outer conductive shield disposed about the fourth insulating material layer;

an outer insulating layer disposed about the outer shield; and whereby the magnetic field interaction between the plurality of line conductors and the plurality of neutral conductors is less than the magnetic field interaction in an electrical power cable having a single line conductor and a single neutral conductor of substantially equal current carrying capacity to the current carrying capacity of the plurality of line conductors and the plurality of neutral conductors.

2. The electrical power cable of claim 1 wherein:

the total cross-sectional area of the plurality of neutral conductors and the total cross-sectional area of the plurality of line conductors is substantially equal to a cross-sectional area of a single larger diameter neutral conductor and a single larger diameter line conductor, respectively, of substantially equal current carrying capacity.

3. The electrical power cable of claim 3 wherein:

the first, second, third, fourth and the outer insulating material layers are formed of a substantially non-compressible material.

4. The electrical power cable of claim 3 further comprising:

an inner electrically conductive ground shield surrounding the first insulating material layer surrounding the ground conductor; and an insulating material layer surrounding the inner shield and contacting the line conductors and the neutral conductors.

5. The electrical power cable of claim 2 wherein the first, second, third, fourth and the outer insulating material layers are formed of PVC.

6. The electrical power cable of claim 3 further comprising:

an outer surface of the ground conductor acting as an inner grounded shield.

7. The electrical power cable of claim 6 wherein:

the first insulating material layer surrounds the inner shield on the outer surface of the ground conductor; and an outer diameter of the first insulating material layer disposing the plurality of line conductors and the plurality of neutral conductors in one annular layer.

8. The electrical power cable of claim 3 wherein:

the plurality of line conductors and the plurality of neutral conductors are each formed of a solid electrical conductor.

9. The electrical power cable of claim 3 wherein:

a total diameter of the ground conductor and the first insulating layer disposes the plurality of line conductors and the plurality of neutral conductors in one annular layer.

10. The electrical power cable of claim 9 wherein the second and third insulating material layers of each of the plurality of line conductors and the plurality of neutral conductors, respectively, is in non-moveable contact with the second and third insulating material layers of adjacent line conductors and neutral conductors.

11. The electrical power cable of claim 3 wherein:

the first, second, third and fourth insulating material layers are provided in thicknesses to dispose outer surfaces of each of the line conductors and each of the neutral conductor at equal spacings from an inner surface of the outer shield, the outer surfaces of adjacent line and neutral conductors, and from an outer surface of the ground conductor.

12. The electrical power cable of claim 2 wherein:

the plurality of line conductors and the plurality of neutral conductors each comprises four 20 gage conductors having a total cross-sectional area substantially equal to a cross-sectional area of one 14 gage conductor.

13. The electrical power cable of claim 2 wherein:

the plurality of line conductors and the plurality of neutral conductors each comprise six 20 gage conductors having a total cross-sectional area substantially equal to one 12 gage conductor.

14. The electrical power cable of claim 1 wherein the plurality of line conductors and the plurality of neutral conductors each comprises four 20 gage conductors having a total cross-sectional area substantially equal to a cross-sectional area of one 14 gage conductor.

15. The electrical power cable of claim 14 wherein:

the ground conductor has a diameter larger than a minimum diameter ground conductor of a cable of substantially equal maximum current carrying capacity as the electrical power cable.

16. The electrical power cable of claim 1 wherein:

the plurality of line conductors and the plurality of neutral conductors each comprises six 20 gage conductors having a total cross-sectional area substantially equal to one 12 gage conductor.

17. The electrical power cable of claim 1 wherein:

the first, second, third, fourth and the outer insulating material layers are formed of a substantially non-compressible material.

18. The electrical power cable of claim 7 wherein the non-compressible material is PVC.

19. The electrical power cable of claim 1 further comprising:

an outer surface of the ground conductor acting as an inner grounded shield.

20. The electrical power cable of claim 19 wherein;

the first insulating material layer surrounds the inner shield on the outer surface of the ground conductor; and an outer diameter of the first insulating material layer disposing the plurality of line conductors and the plurality of neutral conductors in one annular layer.

21. The electrical power cable of claim 1 further comprising:

an electrically conductive, grounded, inner shield surrounding the first insulating material layer; and an insulating material layer surrounding the inner shield and contacting the plurality of line conductors and the plurality of neutral conductors.

22. The electrical power cable of claim 10 wherein:

an outer diameter of the insulating material layer surrounding the inner shield disposes the plurality of line conductors and the plurality of neutral conductors in one annular layer.

23. The electrical power cable of claim 1 wherein:

the plurality of line conductors and the plurality of neutral conductors are each formed of a solid electrical conductor.

24. The electrical power cable of claim 1 wherein:

a total diameter of the ground conductor and the first insulating layer disposes the plurality of line conductors and the plurality of neutral conductors in one annular layer.

25. The electrical power cable of claim 24 wherein the second and third insulating material layers of each of the plurality of line conductors and the plurality of neutral conductors, respectively, arc in non movable contact with the second and third insulating material layers of adjacent line conductors and neutral conductors.

26. The electrical power cable of claim 1 wherein:

the first, second, third and fourth insulating material layers are provided in thicknesses to dispose outer surfaces of each of the line conductors and each of the neutral conductors at equal spacings from an inner surface of the outer shield, the outer surfaces of the adjacent line and the adjacent neutral conductors, and from an inner ground surface spaced radially inward from the line and neutral conductors.

27. The electrical power cable of claim 1 wherein:

at least one of the line and neutral conductors is formed of a plurality of stranded wires, the wires being of identical diameter and arranged in an annular ring about a single wire.

28. The electrical power cable of claim 1 wherein:

the ground conductor has a larger diameter than the diameter of each of the plurality of line conductors of each of the plurality of neutral conductors.

29. An electrical power cable comprising a ground conductor;

a first insulating material layer disposed about the ground conductor;

a plurality of line conductors, each covered with a second layer of insulating material and disposed about the first insulating material layer, the plurality of line conductors disposed side-by-side;

a plurality of neutral conductors, each covered by a third layer of insulating material and disposed about the first insulating material layer; the plurality of neutral conductors disposed side-by-side;

a fourth layer of insulating material surrounding the plurality of line conductors and the plurality of neutral conductors;

an outer conductive shield disposed about the fourth insulating material layer;

an outer insulating layer disposed about the outer shield; and the total cross-sectional area of the plurality of neutral conductors and the total cross-sectional area of the plurality of line conductors is substantially equal to a cross-sectional area of single larger diameter neutral conductor and a single larger diameter line conductor, respectively, of substantially equal current carrying capacity.

30. The electrical power cable of claim 3 wherein:

an outer diameter of the insulating material layer surrounding the ground conductor disposes the plurality of line conductors and the plurality of load conductors in one annular layer.

* * * * *